US007216797B2

(12) United States Patent
Lebras

(10) Patent No.: US 7,216,797 B2
(45) Date of Patent: May 15, 2007

(54) TRAY CONTAINER AND BLANK

(75) Inventor: Philippe Lebras, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/371,297

(22) Filed: Feb. 21, 2003

(65) Prior Publication Data

US 2004/0232034 A1 Nov. 25, 2004

Related U.S. Application Data

(63) Continuation of application No. PCT/US01/26240, filed on Aug. 22, 2001.

(30) Foreign Application Priority Data

Aug. 22, 2000 (GB) ..... 0020629

(51) Int. Cl.
*B65D 5/00* (2006.01)

(52) U.S. Cl. ..... 229/114; 229/117.05; 229/186

(58) Field of Classification Search ..... 206/557; 229/114, 186, 187, 5.84, 117.05, 117.01, 229/117.07, 117.08, 903–906; 426/106, 426/122, 124

See application file for complete search history.

(56) References Cited

U.S. PATENT DOCUMENTS

| | | | | |
|---|---|---|---|---|
| 1,563,907 | A | 2/1925 | Koff | |
| 1,722,338 | A * | 7/1929 | Papendick | 426/124 |
| 2,605,954 | A | 8/1952 | Williamson | |
| 2,724,541 | A | 11/1955 | Metcalf | |
| 2,993,631 | A | 7/1961 | Pasin | |
| 3,137,435 | A | 6/1964 | Meyers | |
| 3,373,923 | A | 3/1968 | Martell | |
| 3,476,305 | A * | 11/1969 | Asman | 229/186 |
| 3,705,681 | A | 12/1972 | Rossi et al. | |
| 3,731,872 | A | 5/1973 | McCormick | |
| 3,734,391 | A | 5/1973 | Manizza | |
| 3,910,483 | A | 10/1975 | Ritter | |
| 4,260,098 | A * | 4/1981 | Manizza et al. | 229/186 |
| 4,343,428 | A * | 8/1982 | Persson | 229/186 |
| 4,747,487 | A | 5/1988 | Wood | |
| 4,819,862 | A * | 4/1989 | Maroszek | 229/117.08 |
| 4,832,257 | A | 5/1989 | Wood | |
| 5,253,802 | A | 10/1993 | Bernard et al. | |
| 5,353,984 | A * | 10/1994 | Liu et al. | 229/114 |
| 5,836,509 | A | 11/1998 | Van Loo | |
| 5,855,317 | A | 1/1999 | Dalrymple | |
| 5,954,263 | A | 9/1999 | Posson | |

FOREIGN PATENT DOCUMENTS

| | | |
|---|---|---|
| EP | 0 178 730 A2 | 4/1986 |
| FR | 914.213 | 10/1946 |
| FR | 2.054.906 | 5/1971 |
| GB | 920831 | 3/1963 |
| GB | 1 237 895 | 6/1971 |
| GB | 1 568 088 | 5/1980 |
| GB | 2 237 796 A | 5/1991 |
| WO | 98/15460 | 4/1998 |

* cited by examiner

*Primary Examiner*—Luan K. Bui
(74) *Attorney, Agent, or Firm*—Tsugihiko Suzuki

(57) ABSTRACT

An article carrier and a blank for forming an article carrier, for holding one or more articles, for example foodstuff or the like, including a base panel, a pair of outwardly sloping side wall panels hingedly connected to the base panel and one or more inwardly sloping end wall panels hingedly connected to the base panel.

14 Claims, 11 Drawing Sheets

TRAY CONTAINER AND BLANK

This is a continuation of international application No. PCT/US01/26240, filed Aug. 22, 2001, which is hereby incorporated by reference.

BACKGROUND OF THE INVENTION

The present invention relates to a article carrier or tray for accommodating one or more articles, for example foodstuff or the like, formed from a blank of paperboard or suitable foldable sheet material, and more particularly to a corner arrangement for retaining liquid from the foodstuff.

Tray structures formed from board generally lack strength when compared to trays formed from plastic material so more commonly trays are formed from polystyrene or other plastics material and the foodstuff is protected by a plastic film.

It is known from WO93/15962 to provide a fluid tight packaging tray formed from cardboard comprising a single base panel surrounded by side and end wall structures connected by an enclosure arrangement to maintain a food tight seal and to prevent liquid from rising by capillarity.

Another example is illustrated in GB 1 237 895 which shows a box formed from a blank with a corner gusset arrangement to impart liquid-proofness to the box body. However, such arrangements involve complex folding operations, which limits the carton construction speeds.

U.S. Pat. No. 4,747,487 to Wood discloses an end loaded carton having an end closure structure comprising triangular corner panels hingedly connected with the lower edge of each side wall and a pair of closure panels hingedly connected to each corner panel and to a bottom end panel via a web panel.

Such trays are commonly of a unitary size which can cause the product to move within the tray which is undesirable as it can lead to degradation of the tray and an unsightly appearance. Furthermore, trays often have a large "foot print" in relation to the size of article to be packaged. Therefore, space is often wasted during storage and delivery of the tray.

SUMMARY OF THE INVENTION

The present invention and its preferred embodiments seek to overcome or at least mitigate the problems of the prior art.

One aspect of the invention provides an article carrier for holding one or more articles, for example foodstuff or the like, comprising a base panel, a pair of outwardly sloping side wall panels hingedly connected to the base panel and one or more inwardly sloping end wall panels, hingedly connected to the base panel. Preferably, the or each end wall panels may be so constructed and arranged to be automatically erected from the flat collapsed condition into a position of use by inwardly folding the opposed side wall panels.

According to an optional feature of this aspect of the invention each of the opposed side wall panels may connect the adjacent end wall panel by a corner arrangement comprising a web panel and an engagement panel wherein the web panel and engagement panel are adapted to be secured in overlapping arrangement. Preferably, the web panel may foldably interconnect the engagement panel by a pair of divergent fold lines to define a substantially triangular gusset panel.

According to another optional feature of this aspect of the invention, the corner arrangement may inhibit the egress of fluid from the base panel at each corner of the carrier.

According to a further optional feature of this aspect of the invention the or each end wall panel may comprise an end panel, opposed web panels hingedly connected to the lateral edges of end panel, the web panels and the end panels being adapted to be folded upwardly and outwardly with respect to the base wall to form a tray.

According to a still further optional feature of this aspect of the invention the opposed side walls and base panel may be two-ply and wherein a void is provided between the inner and outer side wall panels, which void is adapted to receive liquid from the foodstuff. Preferably, the tray may further comprise a plurality of perforations on the inner base panels and/or the fold lines interconnected the base and the side wall panels to facilitate movement of liquid away from the foodstuff to be absorbed by absorbing means placed between the inner and outer base panel.

According to yet another optional feature of this aspect of the invention, the base may be raised at its ends.

A second aspect of the invention provides a blank for forming an article carrier for holding one or more articles, for example foodstuff or the like, comprising a base panel, a pair of outwardly sloping side wall panels hingedly connected to the base panel and one or more inwardly sloping end wall panels, hingedly connected to the base panel wherein each of the opposed side wall panels connect the adjacent end wall panel by a corner arrangement comprising a web panel and an engagement panel.

According to an optional feature of the second aspect of the invention, the web panel may hingedly interconnect the engagement panel by a pair of divergent fold lines to define a substantially triangular gusset panel.

The or each end wall panel of the blank of the second aspect of the invention, may comprise an end panel, opposed web panels hingedly connected to the lateral edges of end panel, the web panels and the end panels being adapted to be folded upwardly and outwardly with respect to the base wall to form a tray.

According to another optional feature of the second aspect of the invention, the opposed side walls and base panel are two-ply. The blank may further comprise a plurality of perforations on the inner base panels and/or said fold lines interconnected the base and the side wall panels to facilitate movement of liquid away from the foodstuff to be absorbed by absorbing means placed between the inner and outer base panel in a set up carrier.

A third aspect of the invention provides a carton for holding one or more articles, for example foodstuff or the like, comprising a base panel, side wall panels and an end wall panel hingedly connected to opposing edges of the base panel and a corner arrangement connecting the side wall to the end wall panel comprising the side panel and in overlying relationship with the end panel. An engagement panel inter-connects and is positioned intermediate the end wall panel and web panel.

Preferably, the or each end wall panels may be so constructed and arranged to be automatically erected from the flat collapsed condition into a position of use by inwardly folding the opposed side wall panels.

According to an optional feature of the third aspect of the invention a first fold line interconnecting the end wall panel and the engagement panel may be aligned with a second fold line interconnecting the side wall panel and web panel when the carton is in blank form.

Preferably, a third fold line may interconnect the web panel and the engagement panel and the angle subtended by the first and third fold lines is substantially the same as the angle subtended by the first fold line and a fourth fold line interconnecting the base wall panel and end wall panel.

According to another optional feature of the third aspect of the invention an engagement panel may be provided intermediate the web panel and engagement panel.

A fourth aspect of the invention provides a blank for forming a carton for holding one or more articles, for example foodstuff or the like, comprising a base panel, having first and second end and side wall panels hingedly connected thereto along opposed side and end edges thereof, the blank further comprising a web panel hingedly connected to a side edge of at least one of the side wall panels and an engagement panel hingedly connected to a side edge of an adjacent one of the end wall panels. The engagement panel and web panel are mutually hingedly connected along a common side edge thereof thereby enabling the engagement panel to be placed intermediate the end wall panels and the web panel when the blank is erected to form a carton.

Preferably, a first fold line interconnecting the end wall panel and the engagement panel may be aligned with a second fold line interconnecting the side wall panel and web panel. More preferably, a third fold line interconnects the web panel and the engagement panel and the angle subtended by the first and third fold lines may be substantially the same as the angle subtended by the first fold line and a fourth fold line interconnecting the base wall panel and end wall panel.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figures 1, 2:
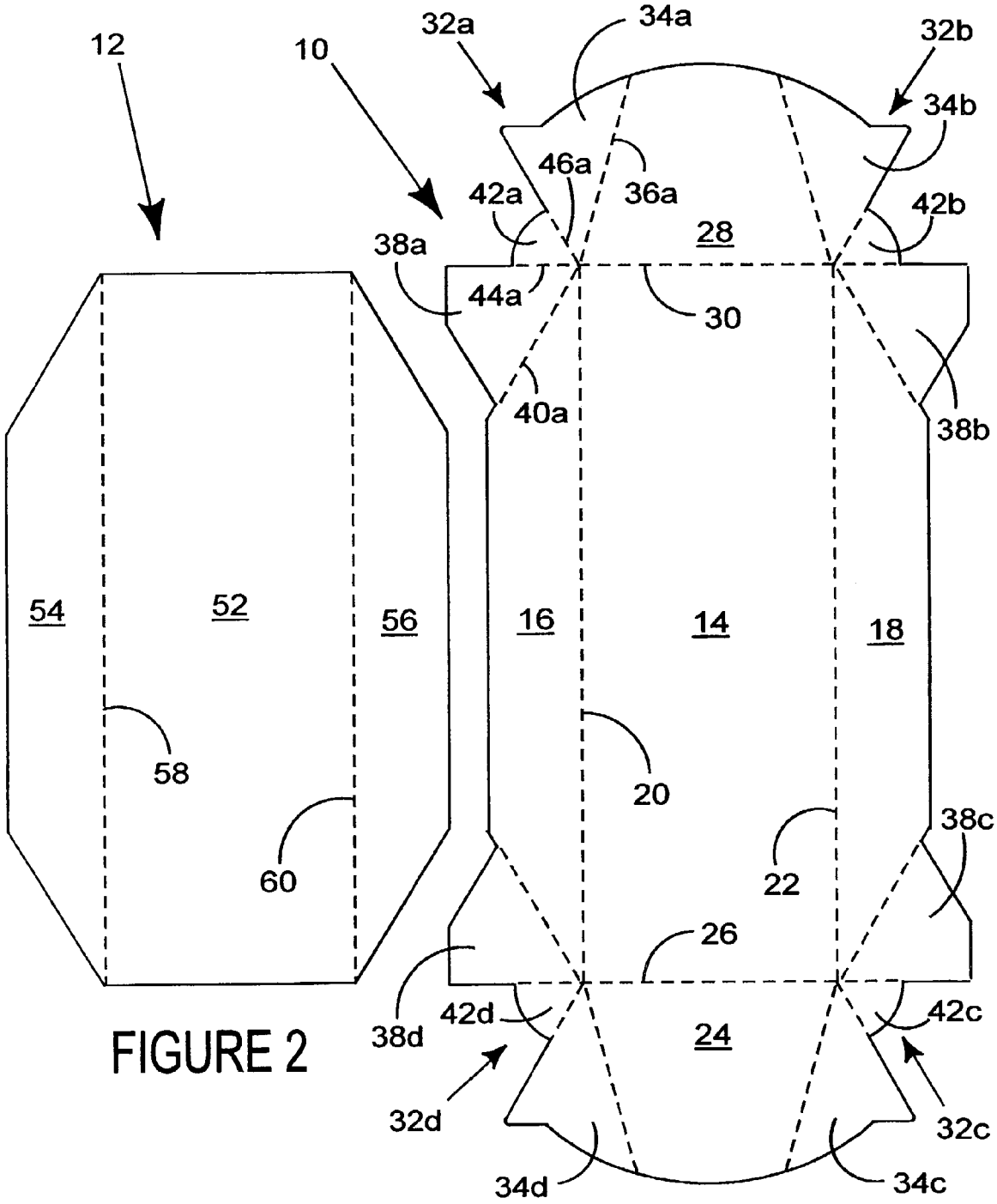
FIGS. 1 and 2 illustrate a two part blank for forming a carton or tray according to a preferred embodiment of the invention.

Referring to the drawings and in particular FIGS. 1 and 2, there is illustrated a blank for forming a collapsible tray (or carton) made from one or more blanks of paperboard or similar foldable sheet material and adapted to hold foodstuff or the like.

Figure 8:
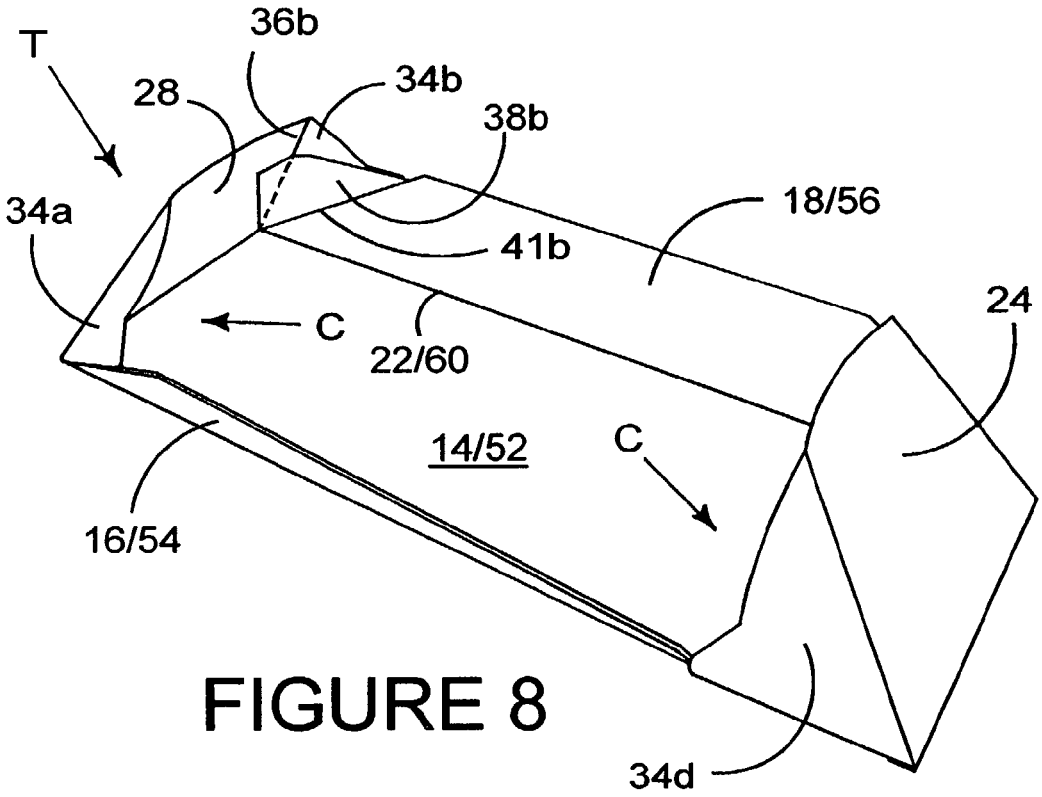
FIG. 8 is a perspective view of the set-up carton illustrated in FIG. 7.
Figure 9:
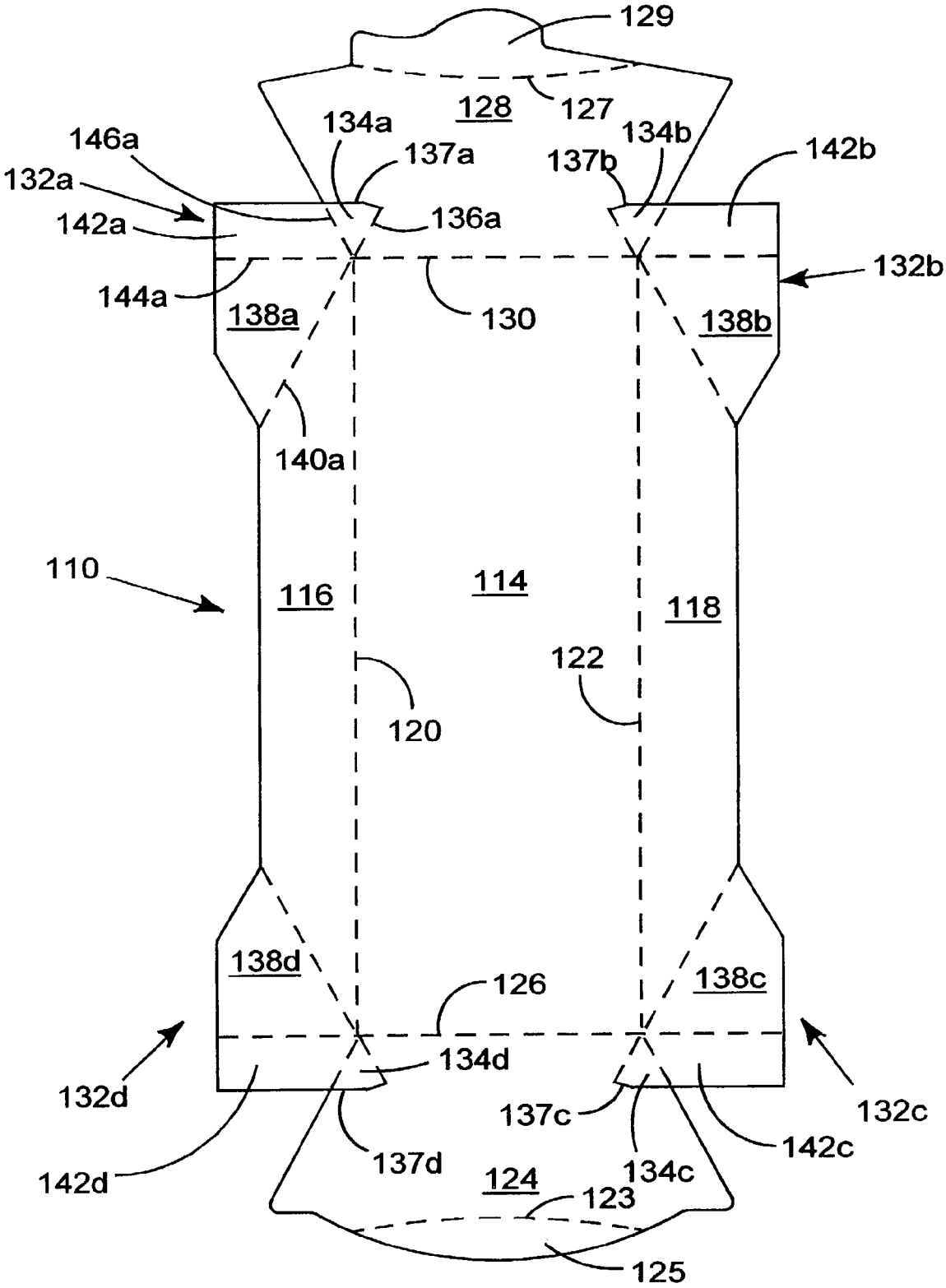
FIG. 9 illustrates a blank for forming a carton or tray according to a second preferred embodiment of the invention.

In this embodiment, the tray is formed from a two part blank although a unitary blank could be used as with the second and third embodiments, without departing from the scope of invention. The blank 10 comprises a plurality of panels for forming the base, opposed sides and ends of the tray T (FIG. 8). Thus, there is shown a base panel 14, a first side wall panel 16 hingedly connected to base panel 14 along fold line 20. A second side wall panel 18 is hingedly connected to the opposing edge of base panel 14 along fold line 22. There further comprises opposed end panels 24 and 28 hingedly connected to base panel 14 along opposed fold lines 26 and 30 respectively. A corner arrangement 32 is provided between each end and adjacent side wall panels for retaining the liquids from the foodstuff. Each corner arrangement is adapted to secure together the side wall panel and an end wall panel of the tray.

Turning in detail to the corner arrangements 32*a*, 32*b*, 32*c*, 32*d*, each corner arrangement is substantially identical and like reference numerals have been used to illustrate the features of the corner arrangement therefore only corner arrangement 32*a* shall be described in any greater detail.

The corner arrangement 32*a* of the first embodiment comprises a web structure hingedly interconnecting the side panel 16 and adjacent end panel 28. In this embodiment, the web structure comprises a gusset panel 34*a* hingedly connected to end wall panel 28 along fold line 36*a*. It will be seen from FIG. 1 that 36*a* is preferably in an acute angular relationship with lateral fold line 30 so that end wall panel 28 is substantially trapezoidal in shape. Of course, the end wall panel is not limited to this shape. In this embodiment, the web structure further comprises a web panel 38*a* and, optionally, one or more engagement panels 42*a* hingedly interconnected along fold line 44*a*. Preferably, fold line 44*a* is an extension of fold line 30. The engagement panel and/or web panel are secured to the end wall panel in a set up condition. In this embodiment, engagement panel 42 is hingedly connected to gusset panel 34*a* along fold line 46*a*. Web panel 38*a* is hingedly connected to first side wall panel 16 along fold line 40*a*. Preferably, fold line 40*a* is in an acute angular relationship with longitudinal fold line 20 so that in use, web panel 38*a* is folded inwardly to come into face contacting relationship with first side wall panel 16 and part of base panel 14.

In this embodiment, a second blank 12 is provided comprising an inner base panel 52 and opposed inner side wall panels 54 and 56 hingedly connected to base panel 52 along fold lines 58 and 60 respectively. The inner blank may be coated with an impermeable layer to prevent the excess liquid from the foodstuff form being absorbed by the tray. As the coating process is expensive, the coated part of the tray is limited to those surfaces that come into direct contact with the foodstuff. Alternatively, a unitary blank such as the embodiment illustrated in FIG. 1 could be used and part (or all) of the inner surface is provided with an impermeable layer.

One advantage with the embodiment illustrated in FIGS. 1 and 2 is that a suitable void structure could be employed between the inner and outer panels, for example similar to the structure disclosed in WO 01/5520 and owned by the applicant.

In the second embodiment illustrated in FIGS. 9 to 13, there is shown a blank 110 for forming the tray which is similar to the first embodiment so like parts have been designated by the same reference numerals with the prefix "1". Only the differences will be described in any greater detail.

A corner arrangement 132 is provided between each end and adjacent side wall panels for retaining the liquids from the foodstuff. Each corner arrangement is adapted to secure together the side wall panel and an end wall panel of the tray.

The blank may further comprise "adpanels" 125 and 129 hingedly interconnected to end wall panels 124 and 128 along fold lines 123 and 127 respectively, and which have no structural purpose, but are provided to display advertising indicia and the like.

Turning in detail to the corner arrangements 132*a*, 132*b*, 132*c*, 132*d*, each corner arrangement is substantially identical and like reference numerals have been used to illustrate the features of the corner arrangement therefore only corner arrangement 132*a* shall be described in any greater detail.

The corner arrangement 132*a* of the second embodiment comprises a web structure hingedly interconnecting the side panel 116 and adjacent end panel 128. In this embodiment, the web structure comprises a gusset panel 134*a* hingedly connected to end panel 128 along fold line 136*a*. It will be seen from FIG. 1 that fold line 136*a* is preferably in an acute angular relationship with lateral fold line 130 so that end wall panel 128 has a substantial trapezoidal portion proximate fold line 130. Of course, the end wall panel is not limited to this shape.

Preferably, gusset panel 134*a* is struck from end panel 128 and partially separated there from by cut line 137*a*. This arrangement provides a flatter pack for when the carton is in a flat collapsed condition.

In this embodiment, the web structure further comprises a web panel 138*a* and optionally, one or more engagement panels 142*a* hingedly interconnected along fold line 144*a*. The web panel 138*a* is connected to gusset panel 134*a*. In this embodiment, engagement panel 142*a* is hingedly connected to gusset panel 134*a* along fold line 146*a*.

In other classes of embodiment, the engagement panel(s) may be dispensed with and the web panel 138*a* is secured directly to the gusset panel 134*a* and/or end wall panel 228.

Preferably, fold line 144*a* is an extension of fold line 130. Web panel 138*a* is hingedly connected to first side wall panel 116 along fold line 140*a*. Fold line 140*a* is in an acute angular relationship with longitudinal fold line 120 so that in use, web panel 138*a* is folded inwardly to come into face contacting relationship with first side wall panel 116 and part of base panel 114. Furthermore, fold line 136*a* is preferably an extension of fold line 140*a* so that in use, gusset panel 134*a* overlies end panel 128 and engagement panel overlies base panel 114. In a particularly preferred embodiment, the angle subtended by fold lines 146*a* and 136*a* is substantially the same as the angle subtended by fold lines 130 and 136*a*.

The third embodiment is illustrated in FIGS. 14 to 19 and corresponds substantially to the fist and second embodiments so that like references have been used with the prefix "2" and only the differences will be described in any greater detail.

The corner arrangements 232 are similar to the corner arrangements 132 of the second embodiment, in that there comprises a gusset panel 234 extending into the adjacent end panel 224, 228. The engagement panel 242 is larger in area to provide a greater area for securing to the end wall panel. Accordingly, the fold line 244 connecting web panel 238 to engagement panel 242 is in an acute angle with respect to fold line 240.

There further comprises inner or as the case may be outer side walls 255, 257 hingedly connected to first and second side wall panels 216, 218 along fold lines 259 and 261 respectively, to provide a two ply structure.

The hinged connection between end panels 224, 228 is a double fold line 230, 231; 226, 227 to make it a flatter pack.

Base wall is formed in three parts so that there is a central base panel 214 and outer base panels 271 and 275 hingedly connected to central base panel 214 along fold lines 273 and 277 respectively. In use, the outer base panels are inclined with respect to central base panel 214 for improved aesthetic effect and to encourage exudate or other fluid from the articles to move towards the central base panel where it is absorbed or collected by suitable absorbent means known in the art.

The construction of the tray T from the blanks 10, 12; 110, 210 illustrated in FIGS. 1 and 2, FIG. 9 or FIG. 14 requires a series of sequential of folding and gluing operations which can be performed either manually or in a straight line machine so that the carton is not required to be rotated or inverted to complete its construction. The folding process is not limited to that described below and be altered according to particular manufacturing requirements.

The compartments C of the tray T, of the illustrated embodiments may be constructed with or without the use of glue. In the present embodiment, a method using glue is shown. The gluing positions of the blank are highlighted by hatching G although it is envisaged that the other glue positions could be adopted if required.

Figure 3:
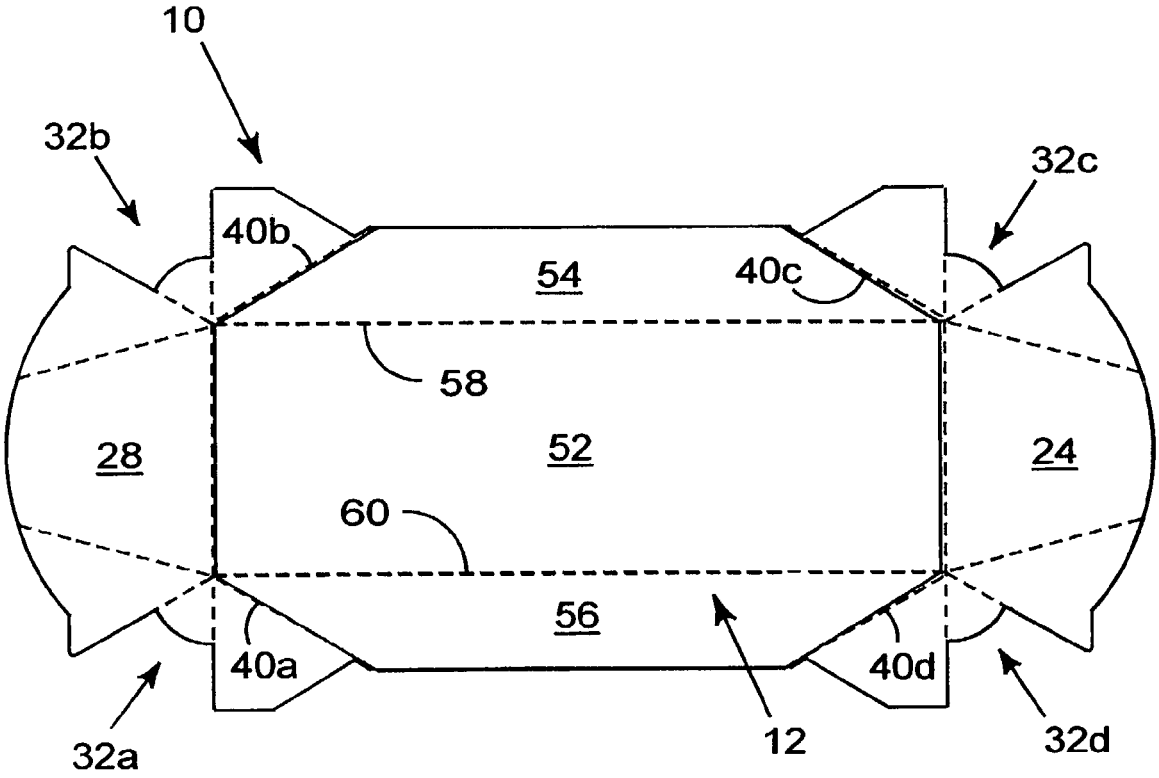
FIGS. 3, 4, 5 and 6 illustrate the construction of the tray from the blanks shown in FIGS. 1 and 2.

The first stage is for the inner and outer blanks 12, 10 to be secured together, in those embodiments with the two part blank. The inner base panel 52 and inner side wall panels 54 and 56 are brought into alignment with corresponding base panel 14 and outer side wall panels 18 and 16 respectively and are secured thereto by glue or other suitable means known in the art. FIG. 3 illustrates the alignment of the inner blank with the outer blank whereby fold lines 58 and 60 are aligned with corresponding fold lines 20 and 22 respectively.

Figure 4:
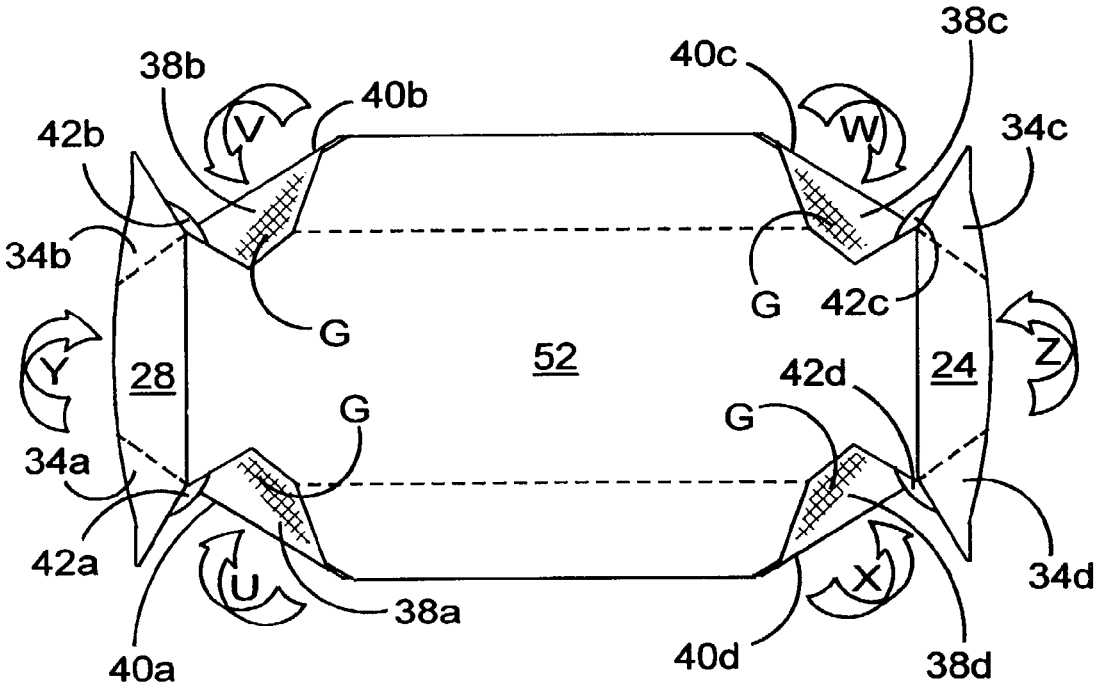
Figure 5:
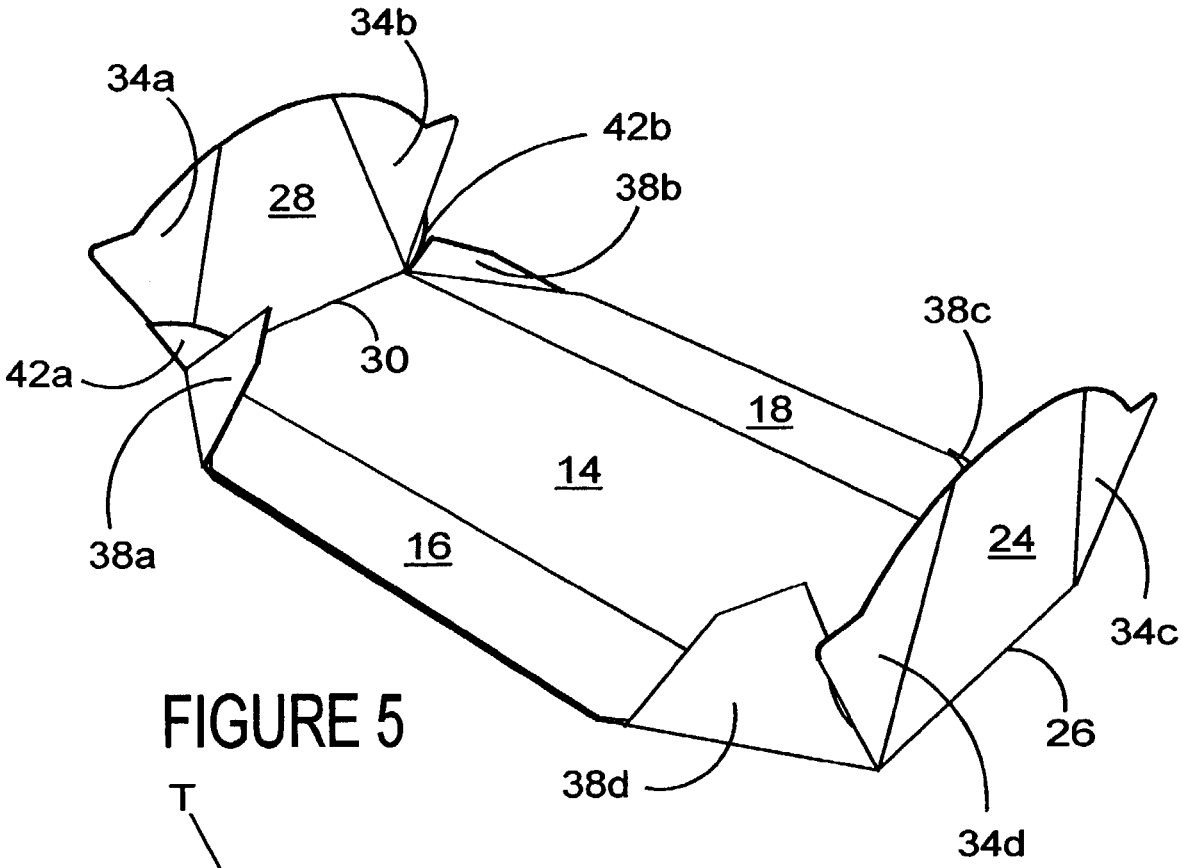
Figure 7:
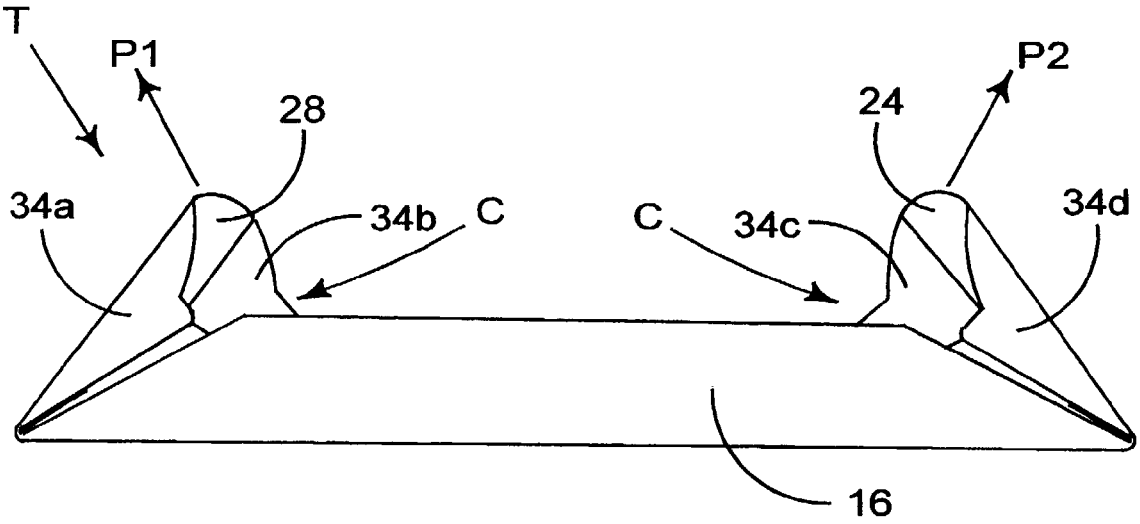
FIG. 7 is a side elevation of the tray in a set-up condition formed from the blanks shown in FIGS. 1 and 2.

It will be seen from FIGS. 7 and 8 that the tray T is formed with one or more inwardly sloping end wall panels 24, 28 and a pair of outwardly sloping side wall panels 16, 18. The end wall structures are formed by constructing each corner arrangement 32 as illustrated in FIGS. 4 and 5. The first step is for the web panels 38*a*, 38*b*, 38*c*, 38*d* to be folded inwardly in directions U, V, W and X respectively along fold lines 40*a*, 40*b*, 40*c* and 40*d*. The web panels 38 are placed in face contacting arrangement with the adjacent side wall panel 16 or 18, as the case may be, and part of inner base panel 52. Glue G is applied to the web panels 38. As the web panels 38 are indirectly connected to end wall panels 24 and 28 by the web structure, the inward folding action of the web panels 38 causes the end wall panels 24 and 28 to be folded inwardly in directions Y and Z so that each engagement panel 42*a*, 42*b*, 42*c* and 42*d* is folded out of alignment with the adjacent gusset panel and web panel 34 and 38 respectively along fold lines 44 and 46, as shown in FIG. 5.

Figure 6:
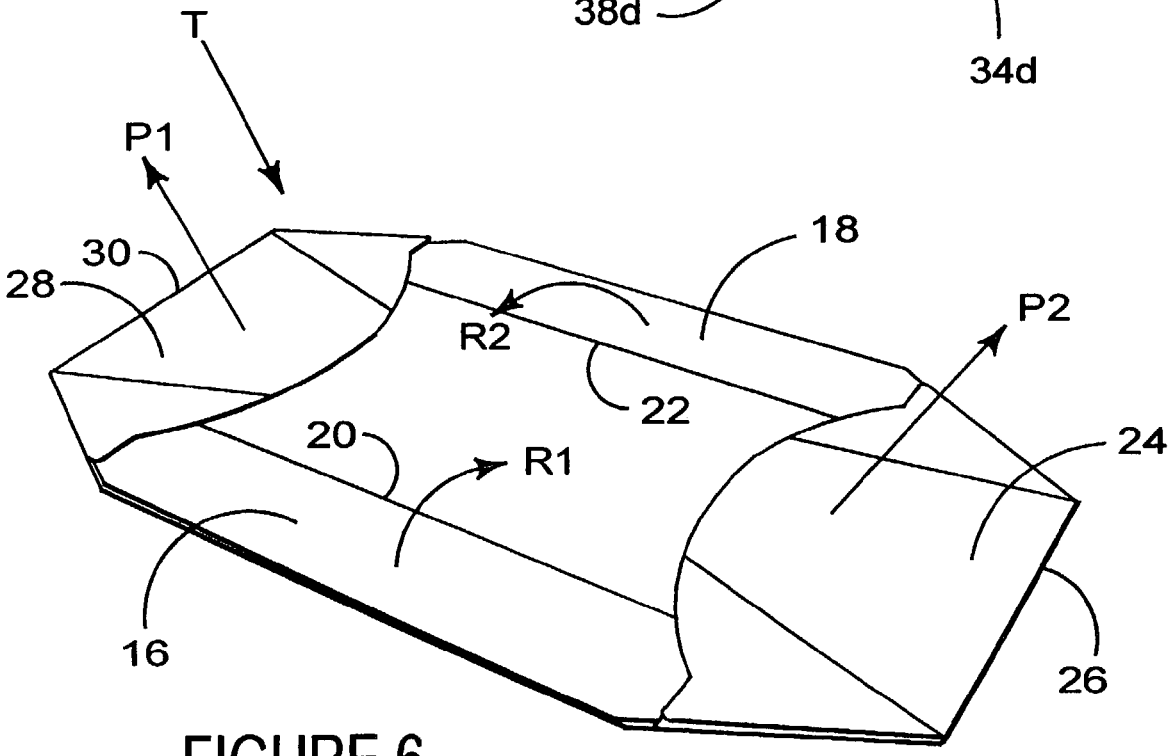

End wall panels 24 and 28 are then folded inwardly so that each gusset panel 34 is placed in overlapping arrangement with the adjacent engagement panel 42 to be placed in face contacting relationship with web panel 38 and is secured therewith. Each end wall panel 24, 28 is inwardly sloping about fold line 26, 30 so that the tray is in a substantially flat collapsed condition as shown in FIG. 6. The tray is ready to be supplied to a user to be loaded with the article(s) or foodstuff.

In order to erect the tray from a flat collapsed condition in FIG. 6 to load it with articles, the side wall panels 16, 18 are folded inwardly in directions R1 and R2 along fold lines 20 and 22 respectively. This folding action causes the end wall structures to be automatically erected from the flat collapsed condition whereby the end wall panels 28, 24 are folded upwardly and outwardly about fold lines 30 and 26 respectively in direction P1 and P2. The article is inserted into the tray and stretch film can thereafter be applied to the tray to seal the package. An advantage of the tray is that the corner arrangements are leak proof and a simple folding arrangement is provided to reduce "folding process" time. Thus, the carton is in a set up condition with compartments C to receive and retain one or more articles, as shown in FIGS. 7 and 8.

Figure 10:
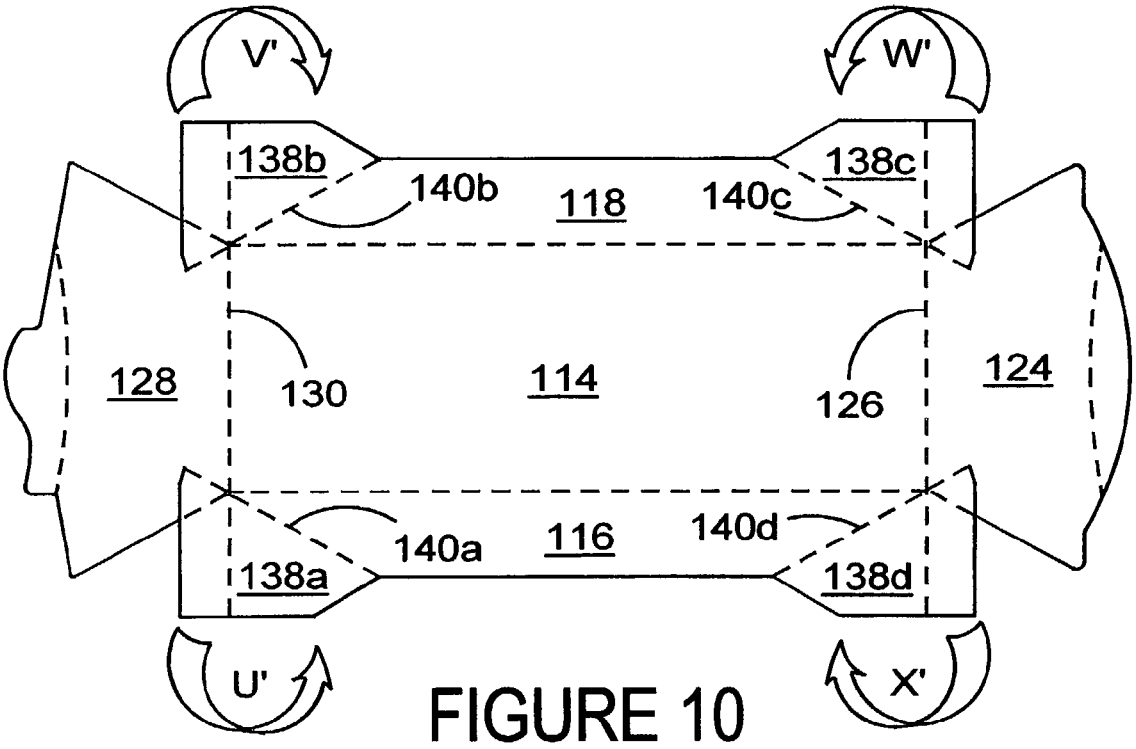
FIGS. 10, 11 and 12 illustrate the construction of the tray from the blanks shown in FIG. 9.
Figure 11:
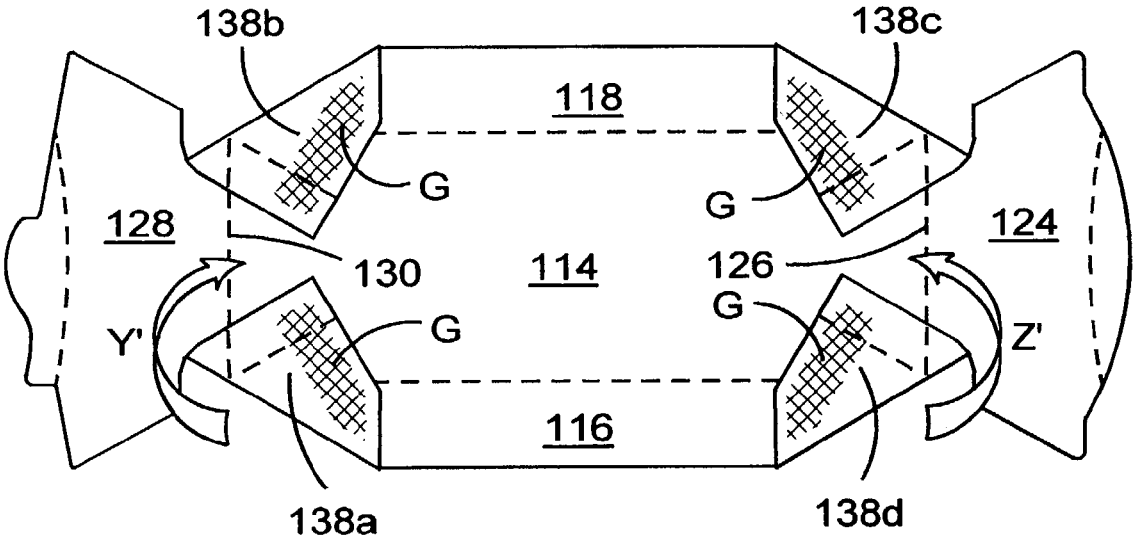
Figure 13:
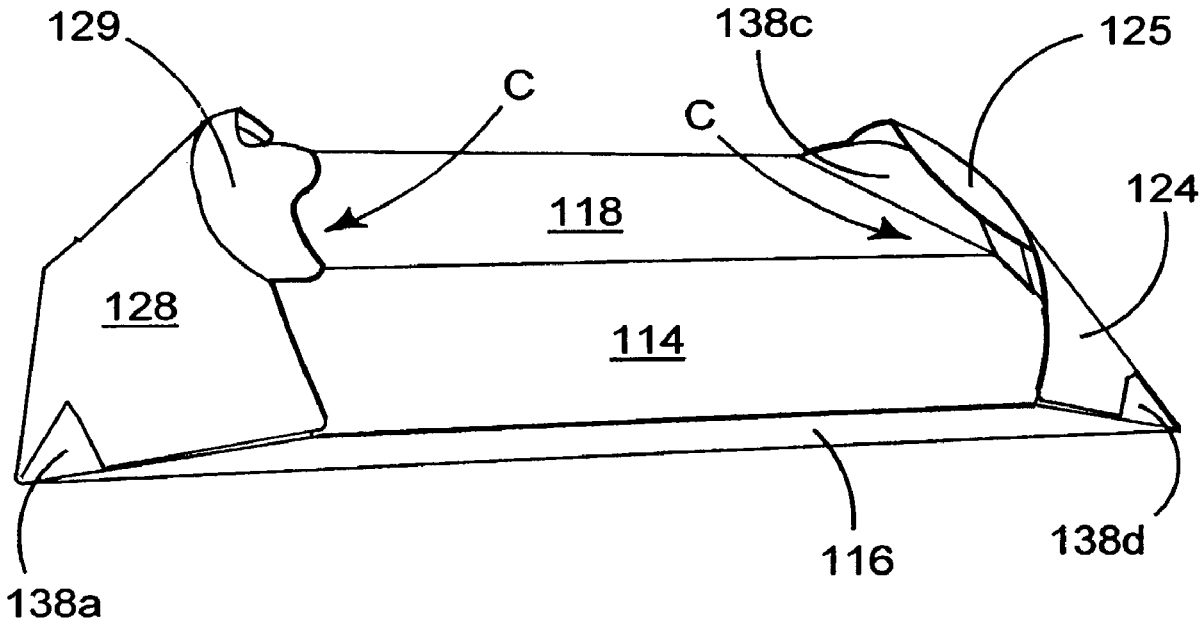
FIG. 13 is a perspective view of the set-up tray formed from the blank of FIG. 9.
Figure 14:
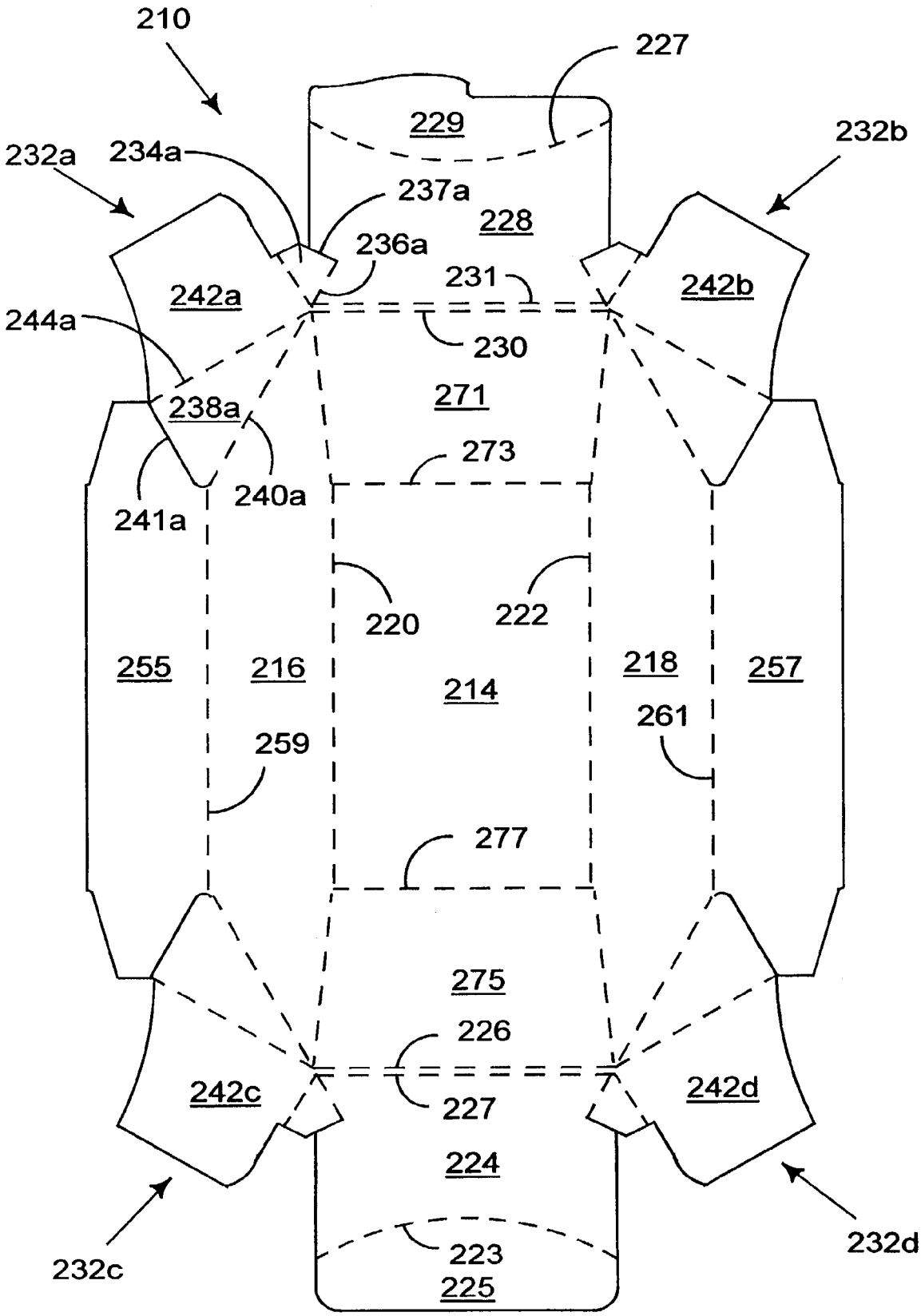
FIG. 14 illustrates a blank for forming a carton or tray according to a third embodiment of the invention.

Turning to the second embodiment, it will be seen from FIG. 13 that the tray is formed with one or more compartments C provided by inwardly sloping end wall panels 124, 128 and a pair of outwardly sloping side wall panels 116, 118. The end wall structures are formed by constructing each corner arrangement 132 as illustrated in FIGS. 10 and 11. The first step is for the web panels 138*a*, 138*b*, 138*c*, 138*d* to be folded inwardly in directions U', V', W' and X' respectively along fold lines 140. The web panels 138 are thus placed in face contacting arrangement with the adjacent side wall panel 116. Glue G is applied to the web panels and/or engagement panels 134.

As the web panels 138 are indirectly connected to end wall panels 124 and 128 by the web structure, the inward folding action of the web panels 138 causes engagement panels 142*a*, 142*b*, 142*c*, 142*d* and gusset panels 134*a*, 134*b*, 134*c*, 134*d* to be folded so as to overlie base wall panel 114 and end wall panels 128 and 124 respectively as can be seen from FIG. 11. This folding action preferably causes fold line 146 to overlie fold line 130. End wall panels 124 and 128 are then folded inwardly in directions Y' and Z' so that each gusset panel 134 is folded out of alignment with the adjacent engagement panel 142 respectively along fold line 146, as shown in FIG. 11.

Figure 12:
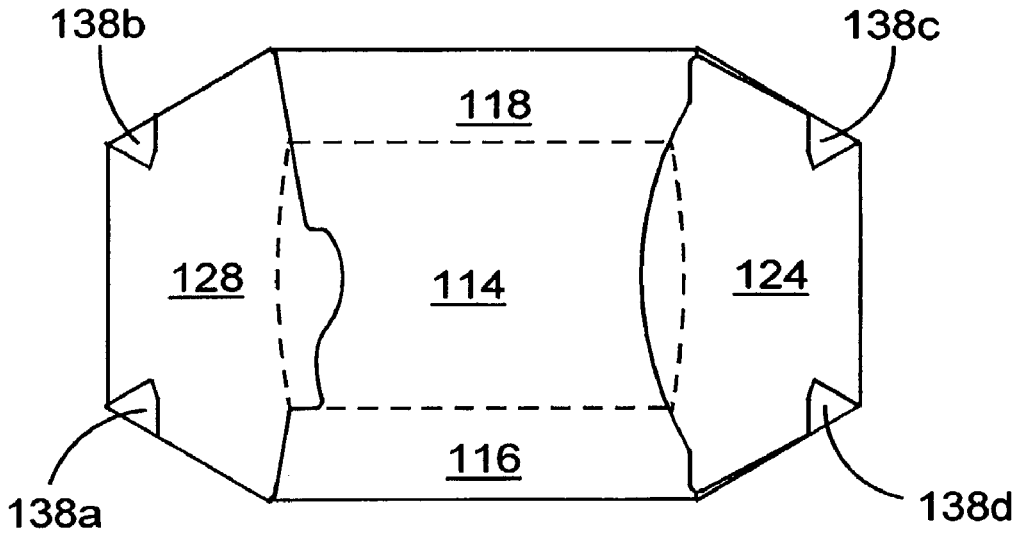

End wall panels 124 and 128 continue to be folded inwardly so that each gusset panel 34 is placed in overlying arrangement with the adjacent engagement panel 142 and portions of the end wall panel are, in this embodiment, secured to web panels 138 and preferably, engagement panels 134 by glue G. This folding action preferably causes fold line 136*a* to overlie fold line 144. End wall panels 124 and 128 are thus inwardly sloping about fold lines 126, 130 so that the tray is in a substantially flat collapsed condition as shown in FIG. 12. The tray is ready to be supplied to a user to be loaded with the article(s) or foodstuffs.

In order to erect the tray from a flat collapsed condition in FIG. 12, the side wall panels 16, 18 are folded inwardly and upwardly along fold lines 120 and 122 respectively. This folding action causes the end wall structures to be automatically erected from the flat collapsed condition whereby the end wall panels 128, 124 are folded upwardly and outwardly about fold lines 130 and 126 respectively as shown in FIG. 13. The article is inserted into the tray and stretch film can thereafter be applied to the tray to seal the package. An advantage of the tray is that the corner arrangements are leak proof and a simple folding arrangement is provided to reduce "folding process" time.

FIG. 13 illustrates the tray in an erected condition ready to receive one or more articles. The shape of the end wall structures provides compartments at each end of the tray to receive and retain part of the article contained in it. The tray is prevented from collapsing by the abutment of the end wall panels 124 and 128 against the article. Furthermore, the tray may be adapted so that the end wall panels 124, 128 and base panel 114 provide a "pincer" arrangement to receive and retain the article thereby to reduce article movement within the tray.

The third embodiment is constructed in like manner to the second embodiment by reference to FIGS. 15 to 17 and therefore only the differences will be described below.

Figure 15:
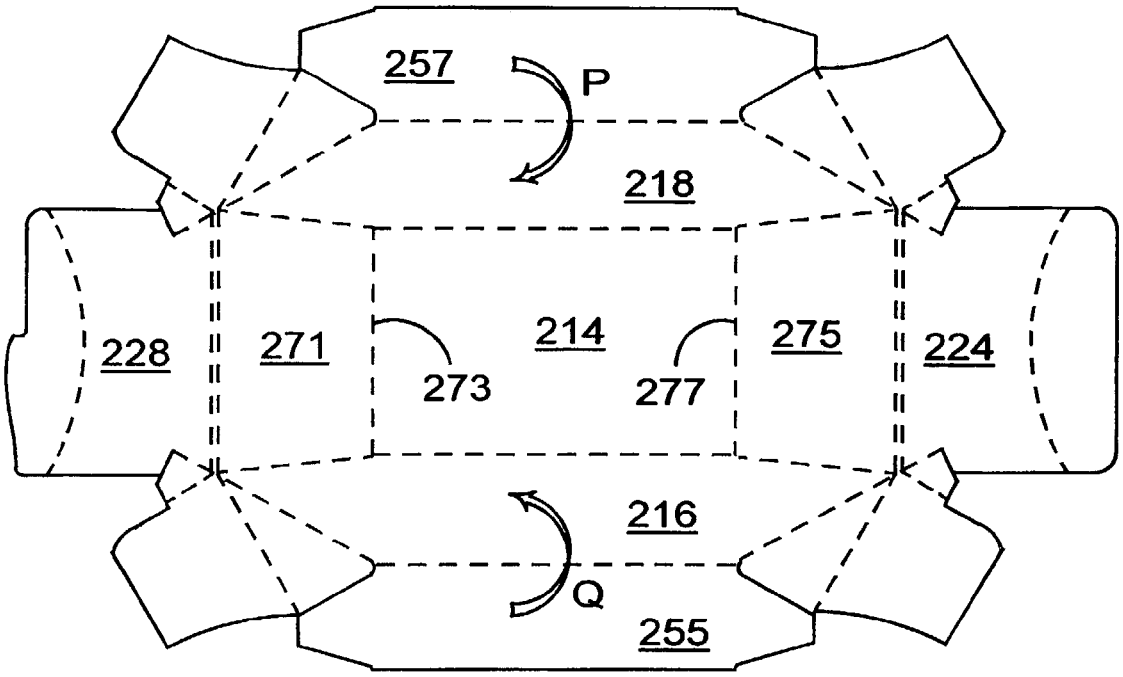
FIGS. 15, 16, 17 and 18 illustrate the construction of the tray from the blank shown in FIG. 14.

The first step, shown in FIG. 15 is to construct the two ply side walls, whereby inner side wall panels 255 and 257 are folded inwardly in directions P and Q along fold lines 259 and 261 respectively and preferably are secured thereto by suitable known securing means, for example glue.

Figure 16:
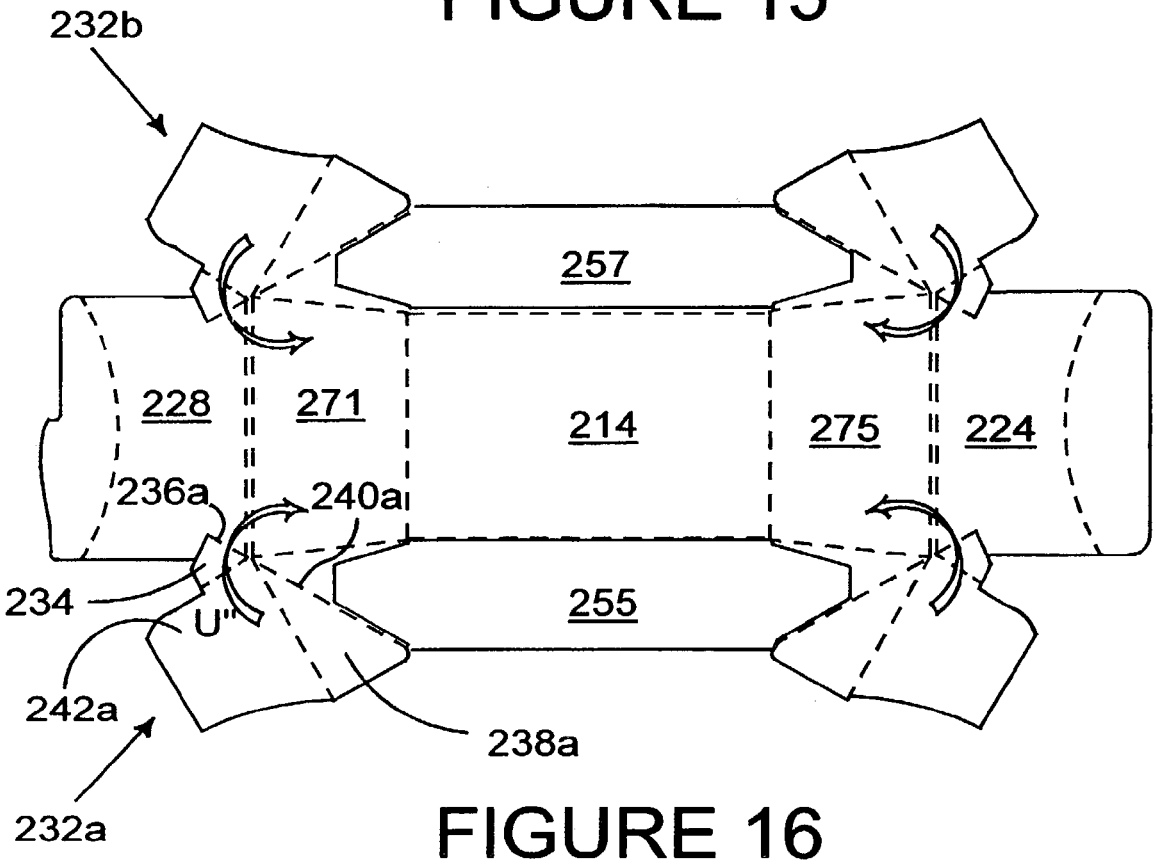
Figure 17:
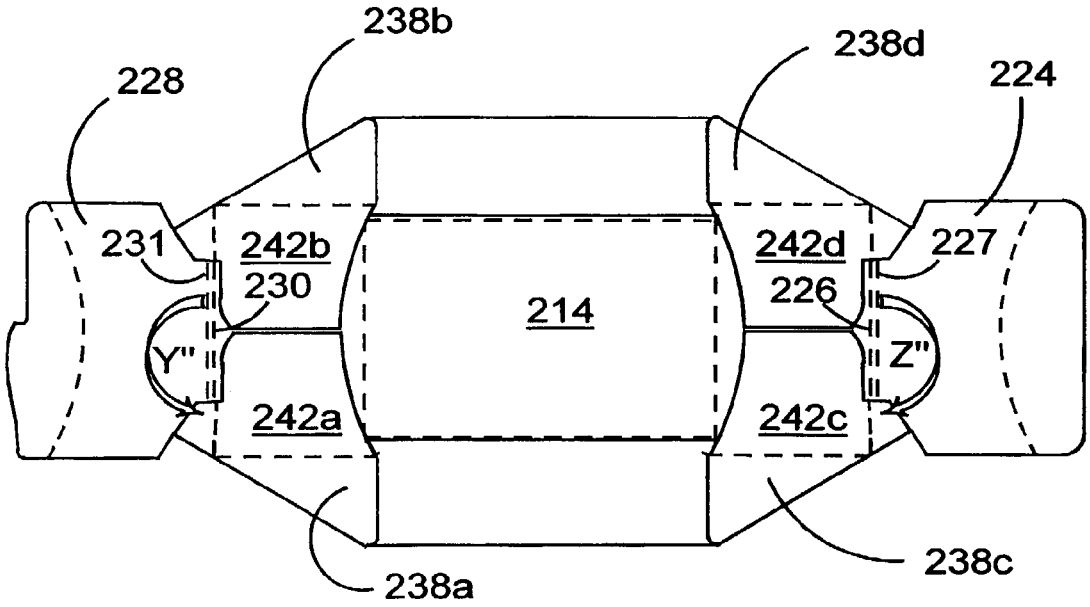
Figure 18:
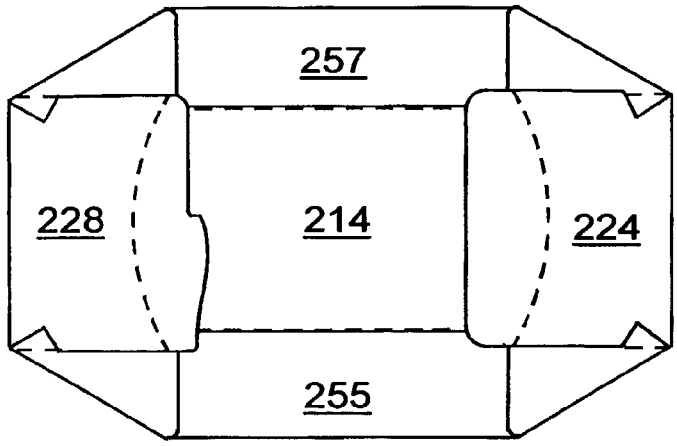

Thereafter, the corner arrangements 232 are constructed in like manner to the second embodiment and shown in FIGS. 16 and 17. The end wall panels 224, 228 are substantially rectangular in shape and are therefore secured to the engagement panels 242 only by glue or other suitable securing means so that the tray is ready to be supplied to an end user in a flat collapsed condition.

The double fold line between the end panels 224, 228 and outer base panels 271, 275 allow a degree of flexing so that the end panels are juxtaposed the adjacent base panel.

Figure 19:
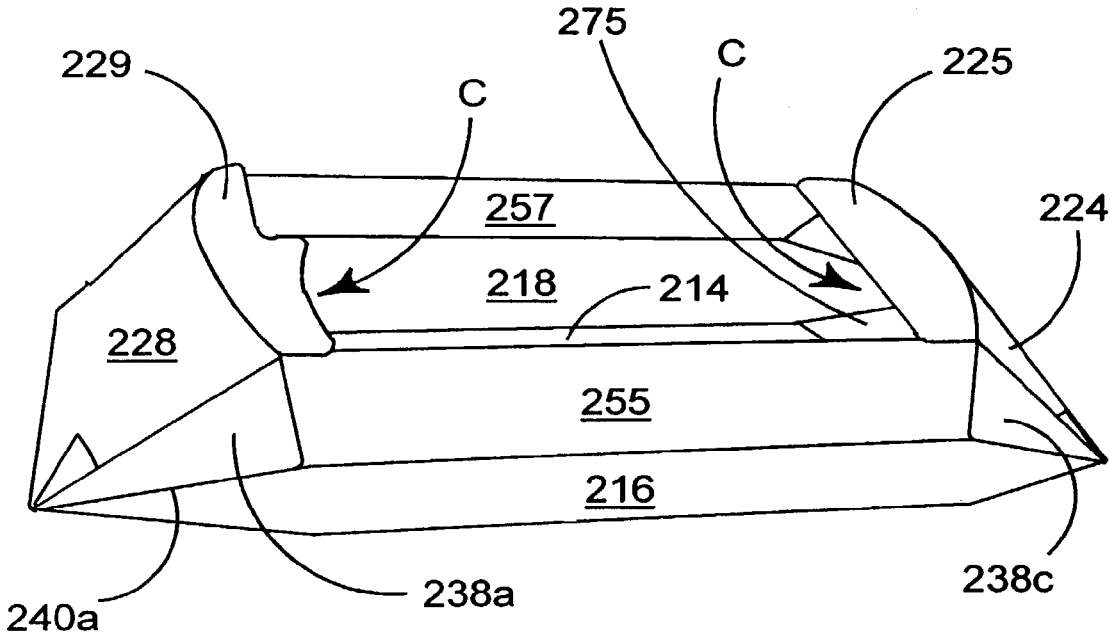
FIG. 19 is a perspective view of the set up tray formed from the blank of FIG. 14.

In order to erect the tray the sides and ends are formed in like manner to the second embodiment, and as shown in FIG. 19. The corner structures are arranged such that as the side walls are erected the outer base panels 271, 275 are inclined with respect to central base panel 214.

In one class of embodiments, the side wall panels 255, 257 are not secured to the first and second side walls and form further ad panels, as shown in FIG. 19.

In the illustrated embodiments the corner arrangements are positioned intermediate the side and end walls, although it is envisaged that the web structures could be formed externally of the end wall structures, without departing from the scope of invention. For example, as with the third embodiment, end walls 224, 228 could be folded inwardly first before construction of the corner arrangement, so that the outer surface of end walls 224, 228 are secured to the inner surface of engagement panels 242. The advantage of this approach is that as the side and end walls are erected the end wall panels will be prevented from folding outwardly and separating from the corner structure as it is held by the engagement panels 242.

The tray of any of the embodiments are shown in FIGS. 7, 8, 13 or 19 in an erected condition ready to receive one or more articles. The shape of the end wall structures provided compartments C at each end of the tray T to receive and retain part of the article contained in it. The tray is prevented from collapsing by the abutment of the end wall panels against the article.

Furthermore, the tray T may be adapted so that the end wall panels and base panel provide a "pincer" arrangement to receive and retain the article thereby to reduce article movement within the tray. In those embodiments comprising a void between the inner and outer tray panels, the end wall panels and corner arrangements restrict upward movement of the inner side wall panels.

Beneficially, the tray described above provides a structure that is strengthened to retain foodstuff. The use of paperboard material provides an environmentally friendly alternative to trays formed from plastics material and the tray can include printed matter for marketing purposes.

It will be recognized that as used herein directional reference such as "top", "base", "end", "side", "inner", "outer", "lateral" and "longitudinal" do not limit the respective panels to such orientation, but merely serve to distinguish these panels from one another. Any reference to hinged connection should not be construed as necessarily referring to a single fold line only: indeed it is envisaged that hinged connection can be formed from one or more of the following: a score line, a frangible line, or a fold line, without departing from the scope of invention.

The present invention and its preferred embodiment relates to an article carrier which is shaped to provide satisfactory rigidity to hold items such as meat or fish securely but with a degree of flexibility. The shape of the blank(s) minimizes the amount of paperboard required for the carton. The items can be applied to the carrier by hand or automatic machinery.

It is anticipated that the invention can be applied to a variety of carton or tray types and not limited to those of a tray like structure. For example, the end closure arrangement can be attached to, say the top or bottom panels, could be applied to cartons in the beverage field without departing from the scope of invention, where it is required to automatically construct end (or side) wall panels of a carton.

The end wall structure could be applied to wraparound or end closure type cartons: the end panels would be foldably connected to a base or top panel and the glue flap secured to the adjacent side panel. Thus, the wraparound carton could be supplied in a flat collapsed form which would not look dissimilar to the end part of the tray shown in FIG. 6. To erect the end wall structure, the side walls would be folded inwardly, by known means, to automatically erect the end wall structure. The carton would then be applied to an array of articles, for example bottles by suitable means and the carton base panels secured together to form a wraparound carrier. Of course, this would result in a further reduction in folding time for forming the carton.

What is claimed is:

1. An article carrier for holding one or more articles, comprising a base panel, a pair of opposed outwardly sloping side wall panels hingedly connected to the base panel, and at least one inwardly sloping end wall panel hingedly connected to the base panel, wherein each of said side wall panels is connected to said at least one end wall panel by a corner arrangement, each of said corner arrangements comprising a web panel hingedly connected to a respective one of said side wall panels, and a gusset panel hingedly connected to said at least one end wall panel, said gusset panel of said each corner arrangement being connected to a respective one of said web panels so that said at least one end wall panel is caused to be erected from a flat collapsed condition into a position of use by inwardly folding said side wall panels, wherein said gusset panel of said each corner arrangement is connected to said at least one end wall panel along a first fold line, said first fold line of said each corner arrangement is aligned with a second fold line interconnecting the respective web panel and an adjacent one of said side wall panels when said carrier is in blank form.

2. The article carrier as claimed in claim 1, wherein said each corner arrangement further comprises an engagement panel hingedly interconnecting the respective web panel and a respective one of said gusset panels, said engagement panel of said each corner arrangement is disposed in overlapping relationship with the respective gusset panel.

3. The article carrier as claimed in claim 2, wherein said engagement panel of said each corner arrangement is hingedly connected to said at least one end wall panel by a pair of divergent fold lines defining a substantially triangular panel comprising a respective one of said gusset panels.

4. The article carrier as claimed in claim 2, wherein said each corner arrangement inhibits egress of fluid from said base panel at each corner of the carrier.

5. The article carrier as claimed in claim 1, wherein said at least one end wall panel is hingedly connected at opposite lateral edges thereof to adjacent ones of said gusset panels, said at least one end wall panel and said adjacent gusset panels are adapted to be folded upwardly and outwardly with respect to said base panel to form an erected tray.

6. The article carrier as claimed in claim 1 wherein said base panel is raised at its ends.

7. The article carrier as claimed in claim 2 wherein said gusset panel of said each corner arrangement is in underlying relationship with said at least one end wall panel, wherein said gusset panel of said each corner arrangement interconnects a respective one of said engagement panels and said at least one end wall panel.

8. The article carrier as claimed in claim 1 wherein said gusset panel of said each corner arrangement is connected to said respective engagement panel along a third fold line, and an angle subtended by said first and third fold line of said each corner arrangement is substantially the same as an angle subtended by said first fold line of said each corner arrangement and a fourth fold line interconnecting said base panel and said at least one end wall panel.

9. The article carrier as claimed in claim 7 wherein said gusset panel of said each corner arrangement is disposed intermediate said respective engagement panel and said at least one end wall panel.

10. A blank for forming an article carrier for holding one or more articles, said blank comprising a base panel, a pair of opposed side wall panels hingedly connected to the base panel and at least one end wall panel hingedly connected to the base panel, wherein each of said opposed side wall panels is connected to said at least one end wall panel by a corner arrangement, each of said corner arrangements comprising a web panel hingedly connected to a respective one of said side wall panels and a gusset panel hingedly connected to said at least one end wall panel, said gusset panel of said each corner arrangement being connected to a respective one of said web panel, wherein a first fold line interconnects said at least one end wall panel and said gusset panel of said each corner arrangement, said first fold line of said each corner arrangement is aligned with a second fold line interconnecting the respective web panel and an adjacent one of said side wall panels.

11. The blank as claimed in claim 10 wherein said each corner arrangement further comprises an engagement panel hingedly interconnecting the respective web panel and a respective one of said gusset panels, wherein said engagement panel of said each corner arrangement is adapted to be disposed in overlapping arrangement with the respective gusset panel in a set up carrier.

12. The blank as claimed claim 11 wherein said engagement panel of said each corner arrangement is hingedly connected to said at least one end wall panel by a pair of divergent fold lines to define the respective gusset panel of a substantially triangular configuration.

13. The blank as claimed in claim 10 wherein said web panel of said each corner arrangement is hingedly connected to a side edge of an adjacent one of said side wall panels, and said gusset panel of said each corner arrangement is hingedly connected to a side edge of said at least one end wall panel, said gusset and web panels of said each corner arrangement being mutually hingedly interconnected thereby enabling said gusset panel of said each corner arrangement to be placed intermediate the respective web panel and said at least one end wall panel when the blank is erected to form a carrier.

14. The blank as claimed in claim 10 wherein a third fold line interconnects said gusset panel of said each corner arrangement and an engagement panel, and an angle subtended by said first and third fold lines of said each corner arrangement is substantially the same as an angle subtended by said first fold line of said each corner arrangement and a fourth fold line interconnecting said base panel and said at least one end wall panel.

* * * * *